US011028468B2

(12) United States Patent
DiFonzo et al.

(10) Patent No.: US 11,028,468 B2
(45) Date of Patent: Jun. 8, 2021

(54) SOFT MAGNETIC ALLOY OPTIMIZED FOR METAL INJECTION MOLDING

(71) Applicant: Apple Inc., Cupertino, CA (US)

(72) Inventors: John C. DiFonzo, Redwood City, CA (US); Abhijeet Misra, Sunnyvale, CA (US); Charles J. Kuehmann, Rolling Hills Estates, CA (US); Daniel T. McDonald, San Jose, CA (US)

(73) Assignee: APPLE INC., Cupertino, CA (US)

( * ) Notice: Subject to any disclaimer, the term of this patent is extended or adjusted under 35 U.S.C. 154(b) by 160 days.

(21) Appl. No.: 16/273,761

(22) Filed: Feb. 12, 2019

(65) Prior Publication Data

US 2020/0107098 A1 Apr. 2, 2020

Related U.S. Application Data

(60) Provisional application No. 62/738,507, filed on Sep. 28, 2018.

(51) Int. Cl.

| | |
|---|---|
| ***C22C 38/10*** | (2006.01) |
| ***H01F 41/02*** | (2006.01) |
| ***H01F 1/147*** | (2006.01) |
| ***C22C 33/02*** | (2006.01) |
| ***H01F 1/22*** | (2006.01) |
| ***H01F 1/20*** | (2006.01) |
| *H04R 1/10* | (2006.01) |

(52) U.S. Cl.

CPC ..... *C22C 38/10* (2013.01); *C22C 33/0285* (2013.01); *H01F 1/147* (2013.01); *H01F 1/22* (2013.01); *H01F 41/0246* (2013.01); *H01F 1/20* (2013.01); *H04R 1/1016* (2013.01)

(58) Field of Classification Search

CPC ..... C22C 33/0285; C22C 38/10; C22C 19/07; C22C 35/005; H04R 1/1016; H01F 41/0246; H01F 1/20; H01F 1/22; H01F 1/147; B22F 2301/15; B22F 2301/35

USPC ..... 148/311, 509

See application file for complete search history.

(56) References Cited

U.S. PATENT DOCUMENTS

| | | | | |
|---|---|---|---|---|
| 1,928,169 | A | 9/1933 | Maish | |
| 2,603,678 | A | 7/1952 | Robert | |
| 5,055,128 | A | 10/1991 | Kiyota et al. | |
| 2015/0287507 | A1* | 10/2015 | Nishio | B22F 3/12 335/297 |

(Continued)

FOREIGN PATENT DOCUMENTS

| | | | |
|---|---|---|---|
| CN | 103946935 | A | 7/2014 |
| JP | H04214801 | A * | 8/1992 |

(Continued)

OTHER PUBLICATIONS

Cui, et al. "High magnetization Fe—Co and Fe—Ni submicron and nanosize particles by thermal decomposition and hydrogen reduction," J. Appl. Phys. 115, 17A315, pp. 1-3 (Year: 2014).*

(Continued)

*Primary Examiner* — Anthony J Zimmer
*Assistant Examiner* — Dean Mazzola
(74) *Attorney, Agent, or Firm* — Dorsey & Whitney LLP

(57) ABSTRACT

A component for an electronic device can include a metal alloy formed by a metal injection molding process. The metal alloy can have a composition of about 32 wt % to about 38 wt % cobalt and about 62 wt % to about 68 wt % iron.

15 Claims, 9 Drawing Sheets

(56) References Cited

U.S. PATENT DOCUMENTS

2020/0082963 A1* 3/2020 Suetsuna ..... H01F 1/14741

FOREIGN PATENT DOCUMENTS

| | | | |
|---|---|---|---|
| JP | H0525593 | A | 2/1993 |
| JP | 2004221120 | A | 8/2004 |
| RO | 125436 | A2 | 5/2010 |
| WO | 2013042692 | A1 | 3/2013 |

OTHER PUBLICATIONS

Bozorth, Richard M., "Iron-Cobalt Alloys", Chapter 6, Ferromagnetism, New York, 1951, pp. 190-209.
European Search Report for EP Application No. EP19192779, dated Oct. 14, 2019 (3 pp.).
Bozorth, Richard M., "Iron-Cobalt Alloys", Chapter 6, Ferromagnetism, New York, 151, pp. 190-209.
Ma, Jidong et al., "Microstructure and Magnetic Properties of Iron-Cobalt-Based Alloys Processed by Metal Injection Moudling", International Journal of Materials Research, Carl Hanser Verlag, Muchen, DE, vol. 109, No. 2, XP009516342, ISSN: 1862-5282. DOI: 10.3139/146.111589, *Figures 1-5; Table 1*, Feb. 12, 2018, 172-176.
Shulze, A., "Zur Konstitution Der Kobalt-Nickel—und Kobalt—Eisenlegierungen", Zeitschrift Für Technische Physik, Leipzig: Barth DE, vol. 8, No. 10, ISSN: 0373-0093 XP008128102, *Table 4*, Jan. 1, 1927, 423-427.
Asano, Hajime et al., "Order-Disorder Transformation of Fe-Co Alloys in Fine Particles", Transactions of the Japan Institute of Metals, vol. 8, No. 3, XP055771761, JP ISSN:0021-4434, DOI: 10.2320/matertrans1960.8.180, Jan. 1, 1967, pp. 180-84.

* cited by examiner

Phase diagram of iron-cobalt alloys.

SOFT MAGNETIC ALLOY OPTIMIZED FOR METAL INJECTION MOLDING

CROSS-REFERENCE TO RELATED APPLICATION(S)

This application claims priority to U.S. Provisional Patent Application No. 62/738,507, filed 28 Sep. 2018, and entitled "SOFT MAGNETIC ALLOY OPTIMIZED FOR METAL INJECTION MOLDING," the entire disclosure of which is hereby incorporated by reference.

FIELD

The described embodiments relate generally to metal alloys. More particularly, the present embodiments relate to articles including metal alloys and methods of forming the same.

BACKGROUND

Soft magnetic materials are ferromagnetic materials, e.g. materials susceptible to magnetic fields, which do not retain their magnetism when an imposed magnetic field is removed. Soft magnetic materials can be useful in many applications, including electromagnetic cores, transformers, shunts, attraction plates, and other components of a magnetic circuit for use in electronic devices.

In many applications, there are two material properties that are most important to the performance of a soft magnetic material: the saturation magnetization (B sat) and the permeability (μ). The permeability of a material is the ability of that material to allow or even amplify a magnetic field imposed on the material. The saturation magnetization of a material is the capacity of that material to retain and respond to the magnetic flux of an imposed magnetic field. That is, the $B_{sat}$ is the density of magnetic flux in a material that corresponds to the saturated magnetization of the material from an applied external magnetic field.

Certain applications can require soft magnetic materials that have both a high saturation and a high permeability to achieve optimal performance levels. It may be desirable in some applications, however, to maximize only one of the saturation or permeability of the material to achieve optimal levels of performance. For example, in some applications, it may be desirable to provide a soft magnetic material that has a high saturation, regardless of the soft magnetic material's permeability.

SUMMARY

According to some aspects of the present disclosure, a magnetic component for an electronic device can include a metal alloy having about 32 weight percent (wt %) to about 38 wt % cobalt and about 62 wt % to about 68 wt % iron.

In some cases, the metal alloy can have an average grain size of about 60 microns to about 100 microns. The metal alloy can have an average pore size of about 2 microns to about 5 microns. The metal alloy can have a density of about 90% to about 98%. The metal alloy can include less than about 60 parts per million (ppm) of each of oxygen, phosphorus, and sulphur. The metal alloy can be in an ordered body-centered cubic phase. The magnetic component can be a magnetic shunt. The magnetic component can be a magnetic retention component. The magnetic component can be configured to interact with an electric circuit to produce an electromotive force.

According to some aspects, an magnetic alloy can include about 34 weight percent (wt %) to about 36 wt % cobalt, about 64 wt % to about 66 wt % iron, and the magnetic alloy can be substantially arranged in an ordered body-centered cubic phase.

In some cases, the alloy can include about 35 wt % cobalt and about 65 wt % iron. The alloy can have a density greater than about 90%. The alloy can have an average grain size of about 60 microns to about 100 microns. The alloy can have an average pore size of about 2 microns to about 5 microns. The alloy can have a saturation magnetization (B sat) of about 2 tesla (T) to about 2.3 T. The component can be a magnetic shunt.

According to some aspects, a method of forming an article from a feedstock can include heating a binder and the feedstock, the feedstock including a material having about 34 weight percent (wt %) to about 36 wt % cobalt and about 64 wt % to about 66 wt % iron, injecting the heated binder and feedstock into a mold, and cooling the heated feedstock to form the article.

In some cases, the feedstock can be a powder and 90% of the particles of the powder can have a maximum diameter of less than about 16 microns. The article can be sintered to remove the binder. The method can further include sintering the article at a temperature between about 600° C. to about 800° C., and cooling the sintered alloy at a rate sufficient that the alloy is substantially arranged in an ordered body-centered cubic phase.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
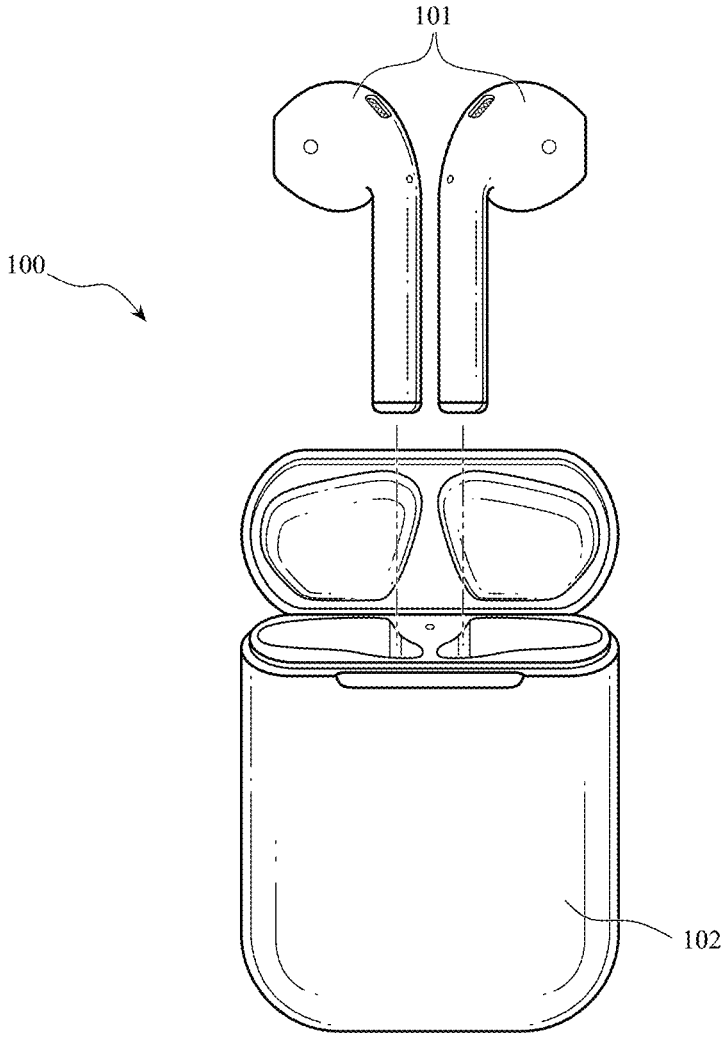
FIG. 1 shows a perspective view of an electronic device.

The present description provides examples, and is not limiting of the scope, applicability, or configuration set forth in the claims. Thus, it will be understood that changes can be made in the function and arrangement of elements discussed without departing from the spirit and scope of the disclosure, and various embodiments can omit, substitute, or add other procedures or components as appropriate. For instance, methods described can be performed in an order different from that described, and various steps can be added, omitted, or combined. Also, features described with respect to some embodiments can be combined in other embodiments.

The present description provides methods, components, such as for an electronic device, alloys, and other articles of manufacture that include or are formed from a soft magnetic alloy having a composition of about 32 wt % to about 38 wt % cobalt and about 62 wt % to about 68 wt % iron. In some cases, the alloy can have a composition of about 34 wt % to about 36 wt % cobalt and about 64 wt % to about 66 wt % iron. In some cases, the alloy can have a composition of about 34.5 wt % to about 35.5 wt % cobalt and about 64.5 wt % to about 65.5 wt % iron. In some cases, the alloy can have a composition of about 35 wt % cobalt and about 65 wt % iron. In some cases, the recited compositions exclude any impurities. It will be understood that the composition of the alloy cannot exceed 100 wt %. Articles and components including the soft magnetic alloy described herein can be used in electronic devices, for example, as a magnetic shunt, attraction components, speaker components, or any other component in a magnetic circuit.

As used herein, formulas for iron cobalt alloys may be written as FeCox, where X is the substantial weight percent of cobalt in the alloy, and 100-X is the substantial weight percent of iron in the alloy, excluding any impurities. That is, an iron cobalt alloy of the formula FeCox has approximately X wt % cobalt and approximately 100-X wt % iron, excluding any impurities. As used herein, the term impurities can refer to elements that may not serve a desired purpose or provide a desired effect to the material properties of the alloy, but which may be present in the alloy as a result of, for example, the processes used to form the alloy. Such impurities can include one or more of nitrogen, oxygen, carbon, phosphorus, or sulphur, in addition to other elements. Further, the iron cobalt alloys described herein can include less than about 5 wt % impurities, less than about 3 wt % impurities, less than about 1 wt % impurities, or less than about 0.5 wt %, 0.25 wt %, 0.1 wt %, 0.01 wt %, or even fewer impurities.

Iron cobalt alloys are known to have amongst the highest magnetic saturation (B sat) of any material. Accordingly, iron cobalt alloys are used as magnetic materials in a wide variety of applications, especially those applications where the B sat of a material is the primary determiner of performance. Traditionally, two formulas of iron cobalt alloys have been used commercially, $FeCo_{50}$ and $FeCo_{27}$.

$FeCo_{50}$ has traditionally been used because it has a relatively high $B_{sat}$ for an iron cobalt alloy composition and also has a relatively high permeability. $FeCo_{50}$ can be difficult to process and form, however, because the temperature must be carefully controlled during processing in order to produce an article that includes the alloy in an ordered body-centered cubic phase. If the processing is not carefully controlled, the formed alloy can include a disordered phase which has a lower $B_{sat}$ and permeability than the alloy in an ordered phase. Articles formed from $FeCo_{50}$ are typically wrought, and the need to control the heat during wrought forming can be expensive and time consuming. Further, $FeCo_{50}$ can be brittle, adding to the alloy's processing difficulties. Typically, other elements such as chromium or vanadium are added to iron cobalt alloys to make these alloys easier to work with and form, or to improve the mechanical properties of the alloy. Such additional elements, however, can lower the $B_{sat}$ and/or permeability of the alloy.

While $FeCo_{27}$ has a similar $B_{sat}$ to $FeCo_{50}$, it has a lower permeability. $FeCo_{27}$, however, does not undergo an ordered-disordered phase transition, so the processing for an article including this alloy does not need to be as carefully controlled to achieve desired levels of $B_{sat}$ and permeability. The comparatively relaxed processing requirements, along with a reduced level of cobalt as compared to $FeCo_{50}$, can result in reduced costs for articles formed from or including $FeCo_{27}$. In addition to reduced monetary costs, the reduced amount of cobalt, relative to $FeCo_{50}$, can be desirable because it can result in a reduced need for cobalt extraction. Cobalt mining and extraction can be both environmentally and socially deleterious, and cobalt can be considered a conflict resource. As such, it can be desirable to limit the amount of cobalt included in an alloy or in an article of manufacture.

As discussed herein, the iron cobalt alloy composition with the absolute highest $B_{sat}$ includes approximately 35 wt % cobalt and approximately 65 wt % iron. This alloy composition includes less cobalt than $FeCo_{50}$, resulting in reduced costs, and only slightly more cobalt than $FeCo_{27}$. Unlike $FeCo_{27}$, however, care must still be taken to control the ordered-disordered phase transition of the alloy. Traditionally, the costs associated with the additional processing needed to control the ordered-disordered phase transition of $FeCo_{35}$ have outweighed the benefits conveyed by the higher $B_{sat}$ of $FeCo_{35}$.

It has surprisingly been found, however, that when an $FeCo_{35}$ alloy is processed or formed by a powder metallurgy process, such as a metal injection molding process, the heat during processing can be effectively controlled so that no or relatively little further processing can be required to control the ordered-disordered phase transition. Accordingly, an article including $FeCo_{35}$ formed by a powder metallurgy process, such as a metal injection molding process, can have a $B_{sat}$ higher than any other iron cobalt alloy composition and can be formed in a variety of shapes without the additional costs and compromises associated with wrought processing or the addition of magnetically detrimental elements, such as vanadium. In some cases, an iron cobalt alloy, for example an alloy having a composition of about 32 wt % to about 38 wt % cobalt and about 62 wt % to about 68 wt % iron can have a $B_{sat}$ of about 1.9 tesla (T) to about 2.58 T, about 2 T to about 2.4 T, about 2.1 T to about 2.4 T, or about 2.1 T to about 2.2 T.

In some cases, an article or component including an iron cobalt alloy, as described herein, can be used as a magnetic shunt. In some cases, a magnetic shunt can be a component in a magnetic circuit, such as in an electronic device. As used herein, the term magnetic shunt, or shunt, is used to refer to any component or material that can adjust or direct magnetic flux, for example as part of a magnetic circuit. In some cases, a magnetic shunt can be any material, article, or component that has magnetic flux passing there through. Further, in some cases, an article or component including an iron cobalt alloy, as described herein, can interact with an electric circuit to produce an electromotive force (EMF). For example, a component including an iron cobalt alloy, as described herein, can be a component in a speaker, such as a dynamic loudspeaker, and can have a magnetic field that opposes a magnetic field generated by a speaker coil to drive the speaker and produce a desired sound.

The components or articles including an iron cobalt alloy described herein can be formed by a powder metallurgy process, such as a metal injection molding process. A metal injection molding process for forming an article including the alloy can include mixing a powder containing the alloy with a binder to form a moldable feedstock material, heating the moldable feedstock material, injecting the heated feedstock material into a mold, and cooling the molded material. The process can further include heat treating the molded material after cooling, for example, in a reducing atmosphere, and/or treating the molded material, for example with a solvent, to remove binder therefrom.

An article or component including the alloy can include impurity elements, for example one or more of nitrogen, oxygen, carbon, phosphorus, or sulphur, in an amount of less than about 60 ppm. In some cases, an iron cobalt alloy, as described herein, can include less than about 50 ppm, less than about 40 ppm, less than about 20 ppm, 10 ppm, 5 ppm, or even substantially 0 ppm of one or more of nitrogen, oxygen, carbon, phosphorus, or sulphur. Further, the article can have a density of greater than about 90%, such as between about 90% and about 98%, and the alloy can be in an ordered body-centered cubic phase. The processes for forming an article or component including the alloy can result in unique microstructural characteristics that may not be achievable by other processing techniques, such as bulk forming processes. For example, the alloy can have an average grain size of from about 60 microns to 90 microns, and can have an average pore size of from about 2 microns to about 4 microns.

These and other embodiments are discussed below with reference to FIGS. 1-9. However, the detailed description given herein with respect to these Figures is for explanatory purposes only, and should not be construed as limiting.

FIG. 1 shows an example electronic device 100 in the form of wireless earbuds 101 and an associated case 102 that can include articles or components containing or formed from a soft magnetic alloy, as discussed herein. The electronic device 100 can correspond to any electronic device, however, including a phone such as a smartphone, a portable media player, a media storage device, a portable digital assistant ("PDA"), a tablet computer, a computer, a mobile communication device, a GPS unit, a remote control device, and other computing devices. The electronic device 100 can be referred to as an electronic device, or a consumer device. Exemplary structures and components of the example electronic device 100 are described in detail below, with reference to FIG. 2.

Figure 2:
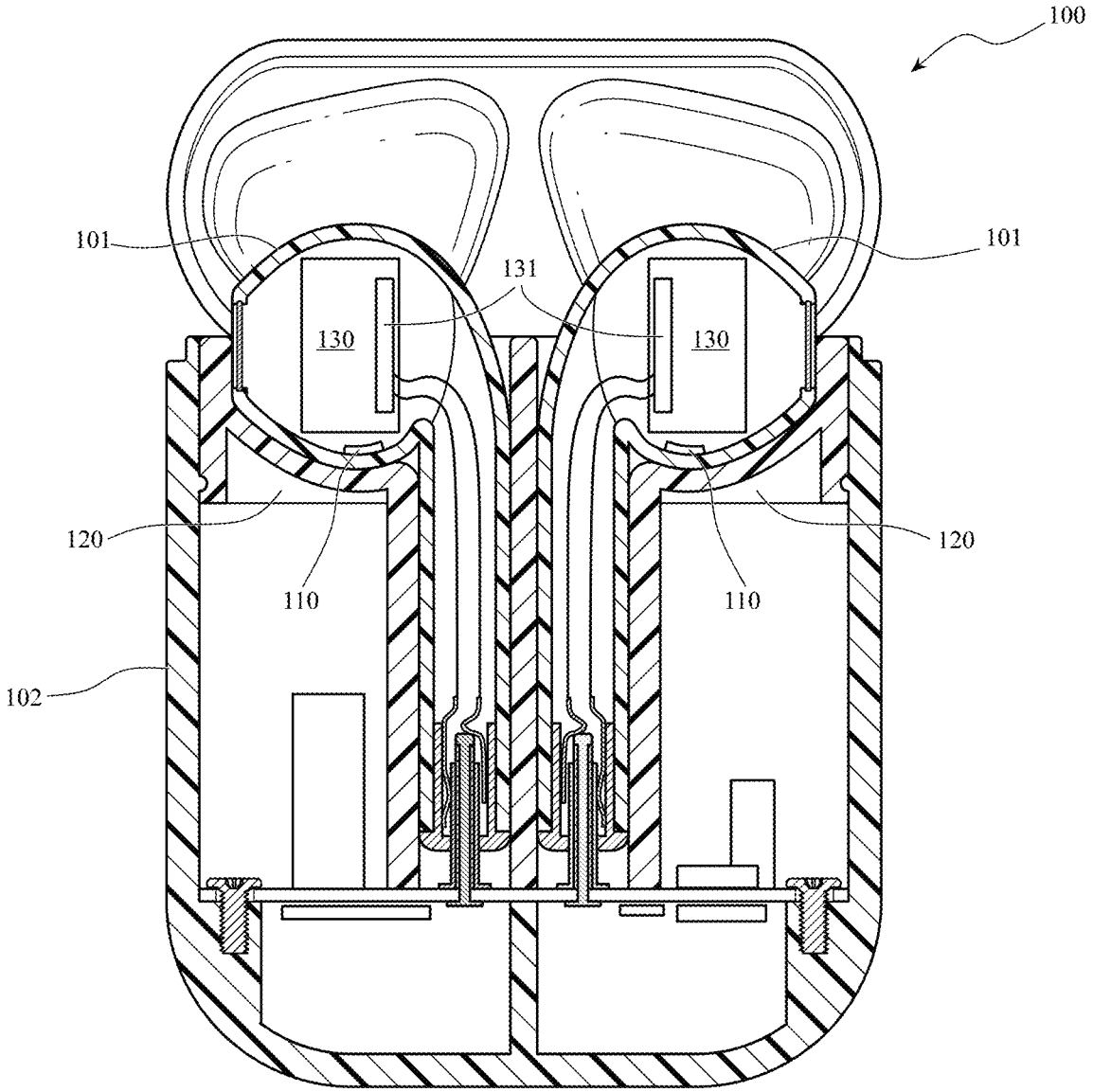
FIG. 2 shows a schematic view of the electronic device of FIG. 1, including a component formed from a soft magnetic material.

Referring now to FIG. 2, the case 102 of the electronic device 100 can include a permanent magnet 120 to retain the wireless earbuds 101 therein. The wireless earbuds 101 can include a component 110 including a metal alloy formed from an iron cobalt alloy having a composition and formed by a process as described herein. In some cases, the component 110 can act as ferromagnetic shunt that can serve as a retention plate. During use, when a user inserts an earbud 101 into the case 102, the iron cobalt alloy retention plate can be magnetically attracted to the permanent magnet 120 to pull the earbud 101 into the case 102 and retain it therein. Further, in some cases, the magnet 120 can include an iron cobalt alloy, as described herein.

Additionally, or alternatively, other components of the electronic device 100 can be formed from or include an iron cobalt alloy as described herein. For example, any component of the electronic device 100 where it is desirable for the component to be formed from or include a material having a high $B_{sat}$. In some cases, the speaker 130 of an earbud 101 can include a magnetic speaker component 131 formed from or including an iron cobalt alloy, as described herein. The device 100 can also include internal components, such as processors, memory, circuit boards, batteries, sensors, and other similar components.

Although illustrated as having a specific shape in FIGS. 1 and 2, an article or component formed form or including an iron cobalt alloy as discussed herein can assume a variety of shapes. For example, in some cases, the article can be substantially continuous or contiguous. In some other cases, however, the article can include any desired apertures, cavities, protrusions, or other features for any given application of the article. Further, an article including an iron cobalt alloy formed by a process such as a metal injection molding process, as discussed herein, can assume any shape that can be achieved by such a process.

The materials and structures of the article 110, 131 formed from an iron cobalt alloy discussed with respect to FIGS. 1 and 2 can include any desired design or shape to serve any number of functions or to provide any number of specifically tailored properties. The following figures and example alloys, processes, and articles illustrate a variety of different embodiments, including an iron cobalt alloy that can be combined in any number or manner of ways. Further details of the iron cobalt alloy are described below with reference to FIGS. 3 and 4.

Figure 3:
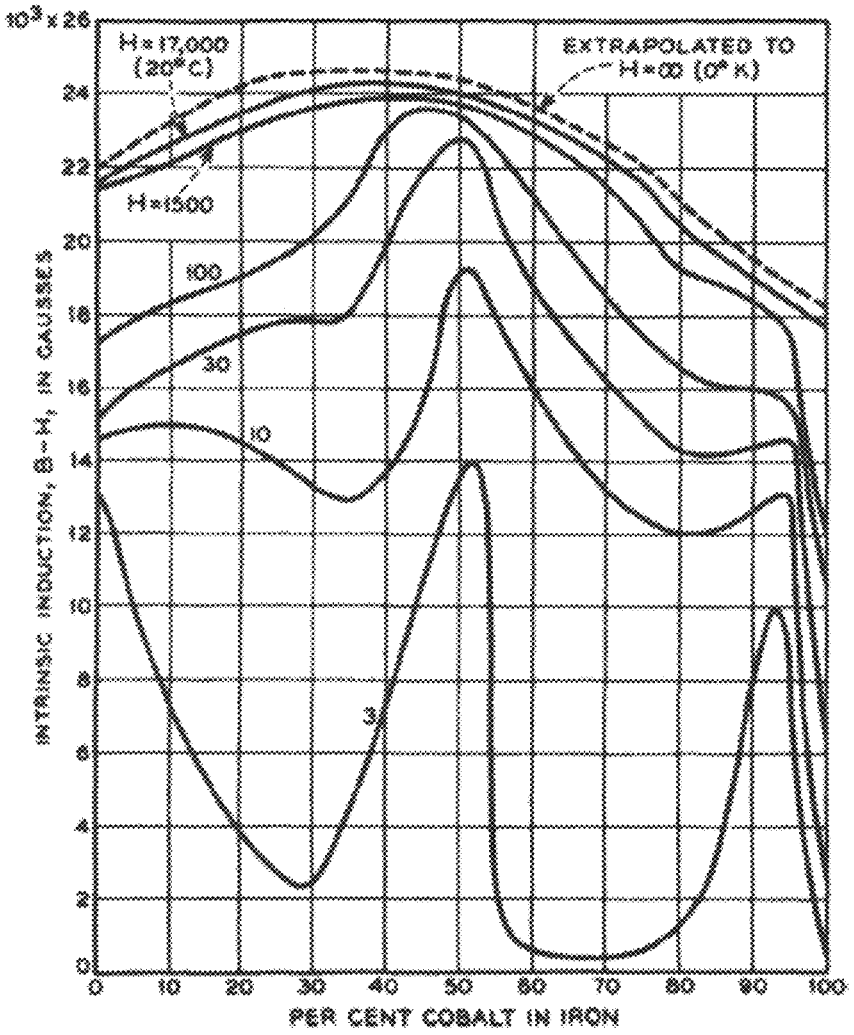
FIG. 3 shows a chart depicting the saturation of an iron cobalt alloy as a function of alloy composition.

FIG. 3 is a chart depicting the intrinsic induction of annealed iron cobalt alloys as a function of alloy composition. The intrinsic induction of a material is directly related to the $B_{sat}$ of the material. Thus, the chart depicted in FIG. 3 effectively depicts the relative $B_{sat}$ of annealed iron cobalt alloys as a function of alloy composition. As discussed above, and as can be seen from the chart, the alloy composition having the absolute highest $B_{sat}$ (shown as the dashed line extrapolated to H=infinity) is $FeCo_{35}$. Further, the $B_{sat}$ of an iron cobalt alloy drops off in both directions as it departs from 35 wt % cobalt.

In some applications, the $B_{sat}$ of an article can be central to achieving a desired level of performance, irrespective of other material or magnetic properties, such as permeability. Accordingly, to achieve an article having as high a $B_{sat}$ as possible, the iron cobalt alloy forming or included in the article can have a formula of $FeCo_{35}$. In some cases, however, an iron cobalt alloy as described herein can have a composition of about 32 wt % cobalt to about 38 wt % cobalt and about 62 wt % to about 68 wt % iron. In some cases, an iron cobalt alloy of such a composition can have the material properties as described herein and can have a $B_{sat}$ that is still sufficiently high for a variety of applications.

The material properties of iron cobalt alloys having about 32 wt % to about 38 wt % cobalt and about 62 wt % to about 68 wt % iron, formed by the processes described herein, can also include material properties that are unique to such iron cobalt alloys. The following figures and example alloys, processes, and articles illustrate a variety of different embodiments including such iron cobalt alloys that can be combined in any number or manner of ways.

Figure 4:
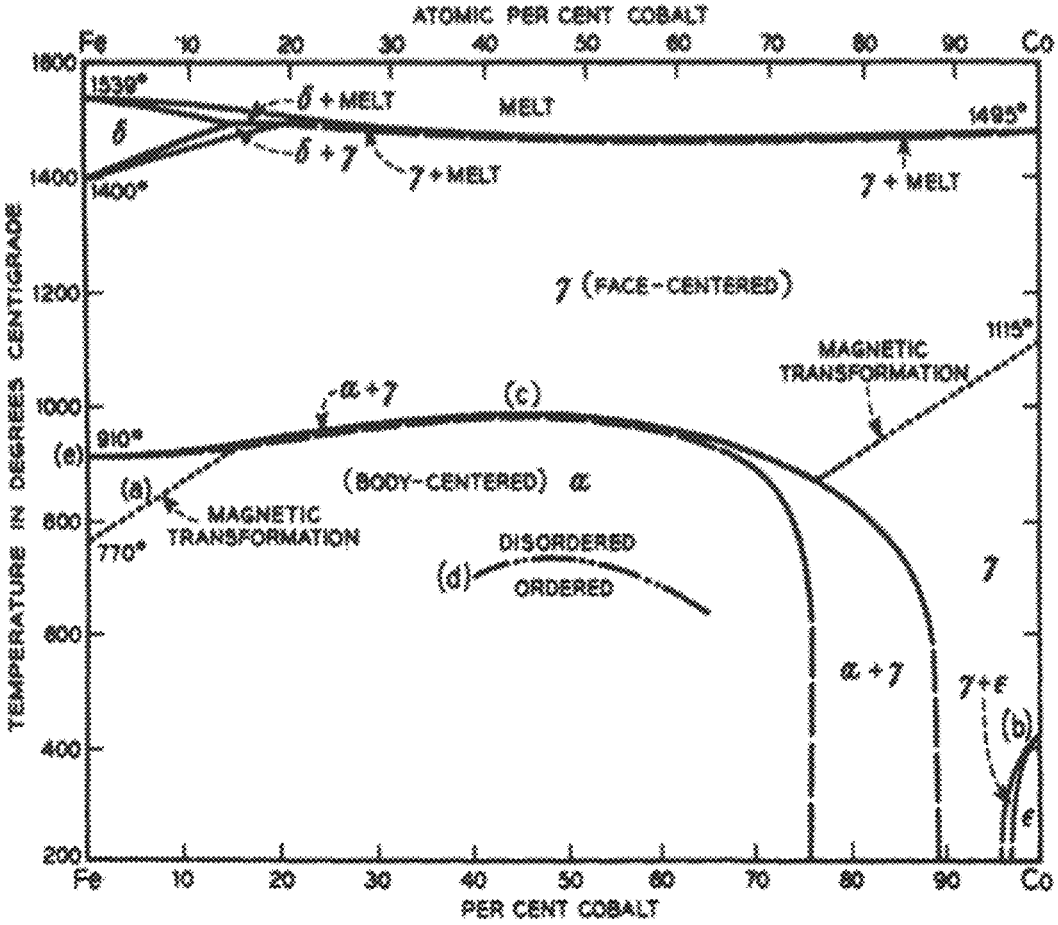
FIG. 4 shows a phase diagram of iron cobalt alloys.

FIG. 4 shows a phase diagram of iron cobalt alloys. As discussed herein, and as can be seen in the phase diagram, iron-cobalt alloys having between about 30 wt % and about 70 wt % cobalt can undergo a phase transition from a disordered phase to an ordered body-centered cubic phase when cooled below about 800° C. to about 600° C. In some cases where an alloy is heated to a temperature above this phase boundary and cooled relatively quickly, the transition from a disordered phase to an ordered phase may not have time to occur throughout all or part of the bulk of the alloy. In some cases, an iron cobalt alloy as described herein, for example $FeCo_{35}$, can be cooled from a temperature above the ordered-disordered phase boundary to a temperature below the phase boundary at a slow enough rate that the phase transition can occur through substantially all of an article formed from the alloy. Accordingly, in some embodiments, an article or component formed from or including an iron cobalt alloy, as described herein, can be substantially entirely in an ordered body-centered cubic phase.

Further, in some examples and as discussed herein, an article formed or molded by a powder metallurgy process such as by metal injection molding an iron cobalt alloy as described herein can be heat treated so that the article is substantially entirely in an ordered body-centered cubic phase. For example, in some embodiments, after an article has been molded or shaped and cooled below a phase boundary, the article can be heated to a temperature above the phase boundary and cooled so that the article is substantially entirely in an ordered body-centered cubic phase.

In some embodiments, this heat treatment can be an additional process or step that the shaped article is subjected to. In some cases, however, treatment to produce an article that is substantially entirely in an ordered body-centered cubic phase can be achieved as part of an existing processes or forming step. For example, a metal injection molding process, as described herein, can include a heating step to sinter or densify the molded article and/or remove or burn off binder from the molded article. Thus, in some embodiments, this sintering and/or binder removal step can involve temperatures and times that can result in an article that is substantially entirely in an ordered body-centered cubic phase.

As a result of the material properties of the $FeCo_{32-38}$ alloy and the metal injection molding process for forming an article including the alloy, the need to incorporate one or more additional elements in the alloy to stabilize the ordered phase or inhibit a transformation from the ordered to disordered phase can be drastically reduced or eliminated. In some embodiments, an iron cobalt alloy as described herein can thus be free or substantially free of additional elements such as vanadium, chromium, copper, tungsten, nickel, manganese, and silicon. In some cases, an iron cobalt alloy according to the present disclosure can have less than about 0.02 wt %, less than about 0.01 wt %, or less of elements such as vanadium, chromium, copper, tungsten, nickel, manganese, and silicon. Further, because the articles described herein do not include these additional elements in the iron cobalt alloy, the $B_{sat}$ of the alloy may be free of undesirable effects often caused by the presence of such additional elements.

The material properties of iron cobalt alloys having about 32 wt % to about 38 wt % cobalt and about 62 wt % to about 68 wt % iron, and formed by the processes described herein, can also include material properties that are unique to such iron cobalt alloys. The following FIGS. 5-9 and associated example alloys, processes, and articles illustrate a variety of different embodiments including the present iron cobalt alloys that can be combined in any number or manner of ways.

Figure 5:
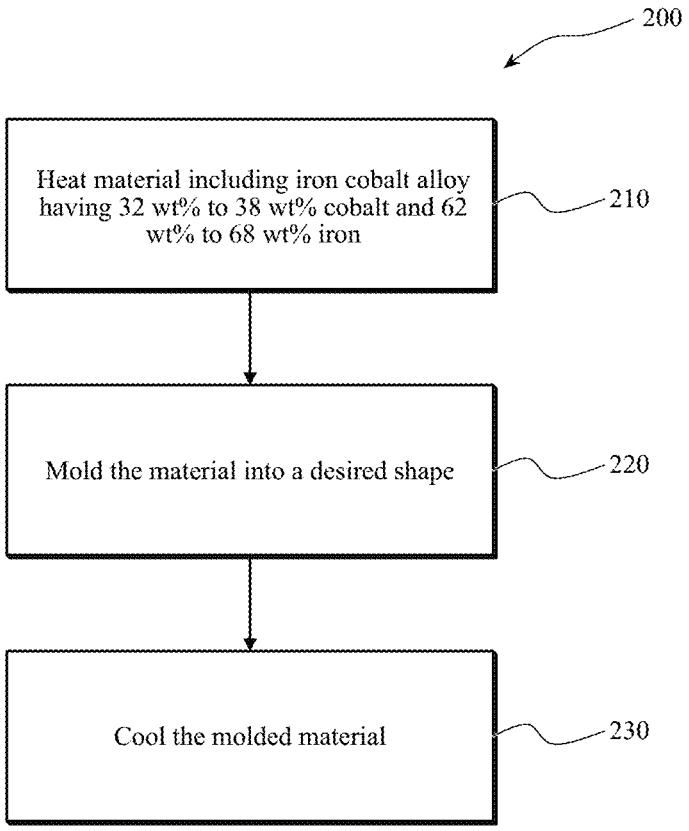
FIG. 5 shows a process flow diagram of a process for forming an article including an iron cobalt alloy.

FIG. 5 shows a flow diagram of a process 200 for forming an article or component including an iron cobalt alloy having about 32 wt % to about 38 wt % cobalt and about 62 wt % to about 68 wt % iron. In some embodiments, the iron cobalt alloy can have the formula $FeCo_{35}$. The process 200 for forming an article or component can include heating a material including an iron cobalt alloy having about 32 wt % to about 38 wt % cobalt and about 62 wt % to about 68 wt % iron, at block 210; molding the material, at block 220, into a desired shape; and cooling the molded material, at block 230. The process can also include additional steps or treatment stages as discussed herein.

At block 210, a material including an iron cobalt alloy having about 32 wt % to about 38 wt % cobalt and about 62 wt % to about 68 wt % iron, is heated. The material can be a powder having a composition of about 32 wt % to about 38 wt % cobalt and about 62 wt % to about 68 wt % iron. In some cases, about 10% of the particles of the powder can have a maximum diameter or major dimension less than about 4 microns. In some cases, about 50% of the particles of the powder can have a maximum diameter or major dimension less than about 9 microns. In some cases, about 80% of the particles of the powder can have a maximum diameter or major dimension less than about 13 microns. In some cases, about 90% of the particles of the powder can have a maximum diameter or major dimension less than about 16 microns. In some cases, about 99.95% of the particles of the powder can have a maximum diameter or major dimension less than about 23 microns. In some cases, the powder can have a tapped density of between about 3 and about 6 grams/$cm^3$, between about 4 and about 5 grams/$cm^3$, between about 4.5 and about 5 grams/$cm^3$, or between about 4.8 and about 5 grams/$cm^3$. In some cases, the powder can have a bulk density of between about 3 and about 6 grams/$cm^3$, between about 4 and about 5 grams/$cm^3$, between about 4 and about 4.5 grams/$cm^3$, or between about 4.2 and about 4.4 grams/$cm^3$.

In some cases, the material can be part of a feedstock. In some embodiments, the material can be combined with a binder material. The binder material can be, for example, an organic or polymeric material such as wax or polypropylene. In some embodiments, the binder can serve to hold or bind particles of the powder, including the iron cobalt alloy together as part of a feedstock or slurry. Thus, in some embodiments, a feedstock can include a powder of the iron cobalt alloy and a binder. The feedstock or material including the iron cobalt alloy can be heated to a temperature high enough to allow the feedstock to be formed in a mold. For example, the feedstock can be heated to a temperature high enough that the feedstock is in a substantially liquid state. In some cases, heating at block 210 results in the feedstock having rheological properties that are conducive to or enable forming in a mold.

The heated material or feedstock can then be molded into a desired shape, at block 220. Any kind, form, or shape of mold can be used to form the feedstock into a molded material having the desired shape, for example, as discussed herein. In some cases, the molding stage can include any kind of powder metallurgy process. For example, the molding stage can include a powder forging process, a hot isostatic pressing process, a metal injection molding process, an electric current assisted sintering process, and additive manufacturing process, such as 3D printing, and combinations thereof.

In some embodiments, the process of block 220 can include a metal injection molding process. For example, in some cases, the process of block 220 can include injecting the heated material including the iron cobalt alloy, for example as part of a feedstock, into a mold having an inverse shape of the article or component desired to be formed. As discussed herein, the mold and/or article can assume any shape or combination of shapes. In some embodiments, the metal injection molding process can include or utilize plastic injection molding machines or apparatuses. In some embodiments, the metal injection molding process can include or utilize machines or apparatuses designed specifically for metal injection molding.

At block 230, the molded material can be cooled. In some cases, the molded material can be cooled to, for example, ambient or room temperature. In some cases, the molded material can be cooled to a temperature low enough that the molded material can substantially retain a desired shape. The cooling can produce a molded body, also referred to as a 'green' body, that can have a substantially similar shape to the desired shape of the article being formed by the exemplary process 200. Although the cooled molded material can have a substantially similar shape to a final formed article, in some embodiments, for example where the material is part of a feedstock, the cooled molded material can include binder material therein. Further, in some embodiments, the cooled molded material can include discrete alloy particles and can have a density substantially lower than a final density of a formed article, as described herein.

The molded or green body can be removed from the mold and in some embodiments, the process 200 can further include additional steps or stages for treating or processing the cooled molded material to form an article including an iron cobalt alloy, as described herein. In some embodiments, the cooled molded material can be subjected to a binder removal treatment or process. Such a binder removal process can include exposing the molded body to a solvent that can dissolve or otherwise remove binder from the molded body, for example, by submerging the molded body in a liquid solvent. In some cases, a binder removal process can include exposing the molded body to a solvent, heating the molded body to a temperature above a binder decomposition or evaporation temperature, performing catalytic processes, and combinations thereof.

The molded body can, in some cases, be subjected to a sintering or densifying process. In some embodiments, a sintering or densifying process can be carried out after an optional binder removal step. In some embodiments, however, a sintering or densifying process can also serve as a binder removal step. Further, in some examples, the molded material can be subjected to a sintering or densifying process prior to being removed from the mold or even prior to being cooled. A sintering or densifying process can include heating the molded body to a temperature below the melting point of the iron cobalt alloy, but high enough to fuse alloy particles together, densify the molded body, and produce a substantially unitary or continuous article or alloy. In some cases, however, the sintering process can be a liquid phase sintering process where the body is heated to a temperature high enough that some partial melting of the alloy can occur.

In some cases, a sintering or densification process can include heating the molded body to one or more temperatures at a desired rate and over a desired amount of time, in accordance with a desired temperature profile. For example, the molded body can be heated to a first temperature at a first rate and held at that temperature for a first duration, and then heated to a second, different temperature at a second rate and held at the second temperature for a second duration. Any number of temperatures and heating stages can be included in the sintering or densification process. Further, in some embodiments, a sintering or densification process can be carried out at elevated pressures, for example above atmospheric pressure. In some embodiments, a sintering or densification process can include an isostatic pressing process, such as a hot isostatic pressing process.

The process 200 can also include a heat treatment stage or step that can result in an article that is substantially entirely in an ordered body-centered cubic phase. For example, in some cases such a treatment process can include heating the molded body to a temperature above an ordered-disordered phase boundary and cooling the molded body at a rate sufficiently slow to produce an article that is substantially entirely in an ordered body-centered cubic phase. In some embodiments, however, this heat treatment stage can be achieved by one or more other stages of the process 200. That is, in some cases, a heat treatment step or stage may not be a separate processing step, but can instead occur during one or more of the processing stages described herein. For example, the treatment to produce an article that is substantially entirely in an ordered body-centered cubic phase can include the binder removal treatment, the sintering or densification treatment, the cooling stage 230, or combinations thereof. Thus, in some embodiments, the temperatures and times involved in the processing steps described herein can be sufficient to achieve a desired treatment, for example, sintering of the molded body, while also resulting in an article that is substantially entirely in an ordered body-centered cubic phase.

In some cases, a heat treatment process, such as a sintering process, can include heating the molded body to a maximum temperature of about 1000° C., or about 1100° C., 1200° C., 1300° C., 1400° C., or greater, In some cases, the heat treatment process can include raising the molded body to a temperature, such as about 1400° C., at a constant or variable rate. In some cases, the heat treatment can include holding the molded body at one or more substantially constant temperatures for a duration during the ramp up to a maximum temperature, such as about 1400° C. In some cases, the molded body can be held at one or more temperature for a duration of about 1 minute, about 5 minutes, about 10 minutes, about 15 minutes, about 20 minutes, about 30 minutes, about 45 minutes, about an hour, or about 2 hours or more during the ramp up to a maximum temperature. In some cases, heat treatment can include holding the molded body at a temperature, such as about 1400° C., for a duration. In some cases, the duration can be up to about 1 hour, up to about 2 hours, up to about 3 hours, up to about 5 hours, or more. In some cases, the heated molded body can be cooled, for example back to an ambient environmental temperature, such as room temperature, at a constant or variable rate including holding one or more temperatures substantially constant for duration, for example, in a similar manner to the ramping profile.

Any of the above described blocks, such as blocks 210, 220, and 230 of process 200, as well as any further treatments, such as a binder removal or sintering treatment, can be carried out in an inert atmosphere, such as an argon or a nitrogen atmosphere. In some cases, any of the above described blocks, such as blocks 210, 220, and 230 of process 200, as well as any further treatments, such as a binder removal or sintering treatment, can be carried out in reduced pressure environment, such as a vacuum. In some cases, any of the above described blocks, such as blocks 210, 220, and 230 of process 200, as well as any further treatments, such as a binder removal or sintering treatment, can be carried out in a reducing atmosphere.

The material properties of iron cobalt alloys having about 32 wt % to about 38 wt % cobalt and about 62 wt % to about 68 wt % iron, formed by the processes described herein, can also include material properties that are unique to such iron cobalt alloys. The following figures and example alloys, processes, and articles illustrate a variety of different embodiments including such iron cobalt alloys that can be combined in any number or manner of ways.

Figure 6:
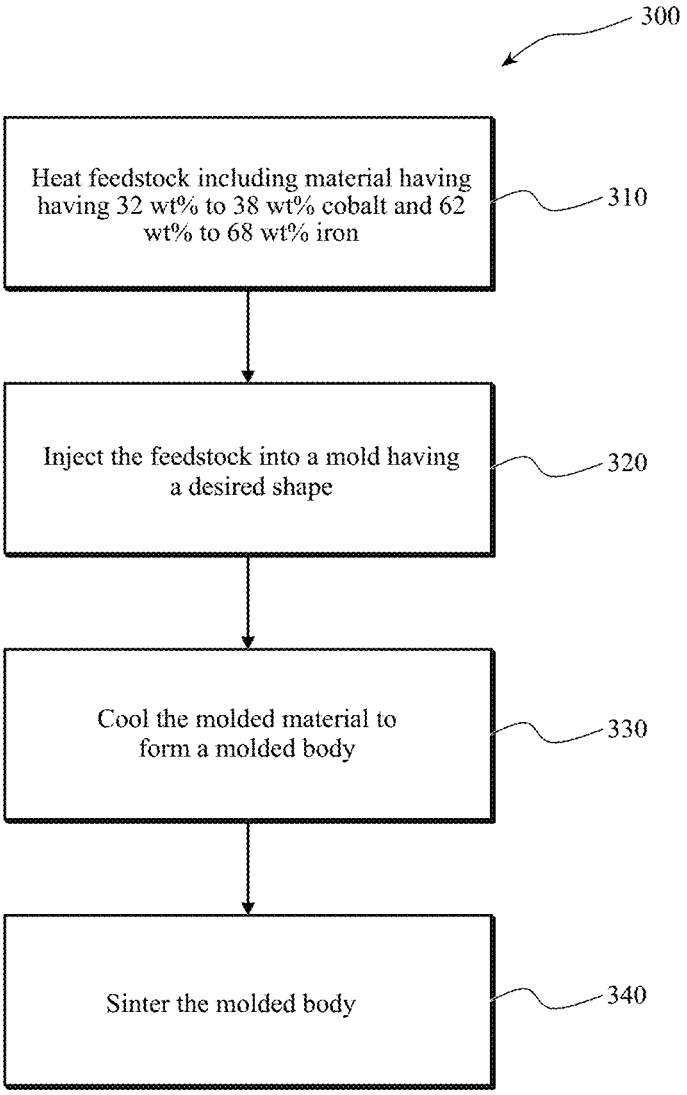
FIG. 6 shows a process flow diagram of a process for forming an iron cobalt alloy from a feedstock.

FIG. 6 shows a flow diagram of a process 300 for forming a metal alloy having a composition about 32 wt % to about 38 wt % cobalt and about 62 wt % to about 68 wt % iron. In some embodiments, the iron cobalt alloy can have the formula $FeCo_{35}$. The process 300 can include heating a feedstock including a material having about 32 wt % to about 38 wt % cobalt and about 62 wt % to about 68 wt % iron, at block 310; injecting the feedstock into a mold, at block 320; cooling the molded material, at block 330; and sintering the molded material, at block 340.

At block 310, a feedstock including a material having about 32 wt % to about 38 wt % cobalt and about 62 wt % to about 68 wt % iron, is heated. The feedstock and heating process can be substantially similar to those discussed with respect to block 210 of FIG. 5. The material included in the feedstock can be a powder having a composition of about 32 wt % to about 38 wt % cobalt and about 62 wt % to about 68 wt % iron. For example, the material can be a metal alloy powder having to formula $FeCo_{35}$. In some embodiments, the feedstock can also include an organic or polymeric binder material. Thus, in some embodiments, the feedstock can be a slurry including a binder and an iron cobalt alloy powder having a composition of about 32 wt % to about 38 wt % cobalt and about 62 wt % to about 68 wt % iron. The feedstock including the material can be heated to a temperature such that the slurry has rheological properties or characteristics that can allow or enable the injection process of block 320.

At block 320, the heated feedstock including the material having about 32 wt % to about 38 wt % cobalt and about 62 wt % to about 68 wt % iron is injected into a mold. The mold can have any desired shape or form, and in some cases, can have a shape substantially the inverse of or corresponding to a shape of the final formed article. In some embodiments, injecting the feedstock can include metal injection molding. For example, in some cases where the feedstock is a slurry including a binder and an iron cobalt alloy powder, the heated feedstock can be injected into a mold under pressure. In some cases, the process can include or utilize plastic injection molding machines or apparatuses. In some embodiments, the metal injection molding process can include or utilize machines or apparatuses designed specifically for metal injection molding.

The injection molded material can be cooled at block 330. Block 330 can be carried out in a substantially similar manner to block 230 of FIG. 5, as discussed herein. The injection molded material can be cooled to, for example, ambient or room temperature. In some cases, the molded material can be cooled to a temperature low enough that the molded material can substantially retain a desired shape. The cooling can produce a molded body, also referred to as a 'green' body, that has a substantially similar shape to the desired shape of the article being formed by process 300. Although the cooled molded material can have a substantially similar shape to a final formed article, in some embodiments, the cooled molded material can include binder material therein. Further, in some embodiments, the cooled molded material can include discrete alloy particles and can have a density substantially lower than a final density of a formed article, as described herein.

The molded body or material can be sintered or otherwise densified at block 340. In some cases, the molded material can be removed from the mold prior to the sintering or densifying. In some cases, sintering or densifying can include heating the molded material to one or more temperatures to sinter or fuse particles of the material, for example, to a form a substantially unitary or continuous body or alloy. In some cases, sintering can include heating the molded material to a temperature below the melting point of the iron cobalt alloy. In some cases, however, sintering can include liquid phase sintering where the body can be heated to a temperature at or near the melting point of the iron cobalt alloy so that partial melting and reflowing, for example via capillary action, can occur.

In some cases, a sintering or densification process can include heating the molded body to one or more temperatures at a desired rate and over a desired amount of time, in accordance with a desired temperature profile. Further, in some embodiments, a sintering or densification process can be carried out at elevated pressures, for example, above atmospheric pressure. In some embodiments, a sintering or densification process can include an isostatic pressing process, such as a hot isostatic pressing process.

The sintering or densification of block 330 can be carried out in such a manner, for example, by heating to one or more desired temperatures, cooling the sintered alloy, and controlling the heating and/or cooling rates of the alloy, that the resultant sintered alloy is substantially in an ordered body-centered cubic phase. For example, in some cases, sintering at block 340 can include heating the molded body to a temperature above an ordered-disordered phase boundary and cooling the molded body at a rate sufficiently slow to produce an article that is substantially in an ordered body-centered cubic phase. The sintering can be carried out in an inert atmosphere, such as an argon or a nitrogen atmosphere. In some cases, any of the above described blocks, such as blocks 310, 320, 330, 340 of process 300, as well as any further treatments, such as a binder removal or sintering treatment can be carried out in a reduced pressure environment, such as a vacuum. In some cases, any of the above described blocks, such as blocks 310, 320, 330, and 340 of process 300, as well as any further treatments, such as a binder removal or sintering treatment can be carried out in a reducing atmosphere.

In some cases, the process 300 can further include additional steps or stages for treating or processing the molded body or alloy, for example, to form an article including an iron cobalt alloy, as described herein. In some embodiments, the molded body or alloy can be subjected to a binder removal treatment or process. Such a binder removal process can include exposing the molded body to a solvent that can dissolve or otherwise remove binder from the molded body, for example, by submerging the molded body in a liquid solvent. In some cases, a binder removal process can include exposing the molded body to a solvent, heating the molded body to a temperature above a binder decomposition or evaporation temperature, performing catalytic processes, and combinations thereof.

Any of the above described blocks, such as blocks 310, 320, 330, and 340 of process 300, as well as any further treatments, such as a binder removal or sintering treatment, can be carried out in an inert atmosphere, such as an argon or nitrogen atmosphere. In some cases, any of the above described blocks of process 300, as well as any further treatments, such as a binder removal or sintering treatment, can be carried out in reduced pressure environment, such as a vacuum.

The material properties of iron cobalt alloys having about 32 wt % to about 38 wt % cobalt and about 62 wt % to about 68 wt % iron, and formed by the processes described herein, can also include material properties that are unique to such iron cobalt alloys. The following figures and example alloys, processes, and articles illustrate a variety of different embodiments including such iron cobalt alloys that can be combined in any number or manner of ways.

Figure 7:
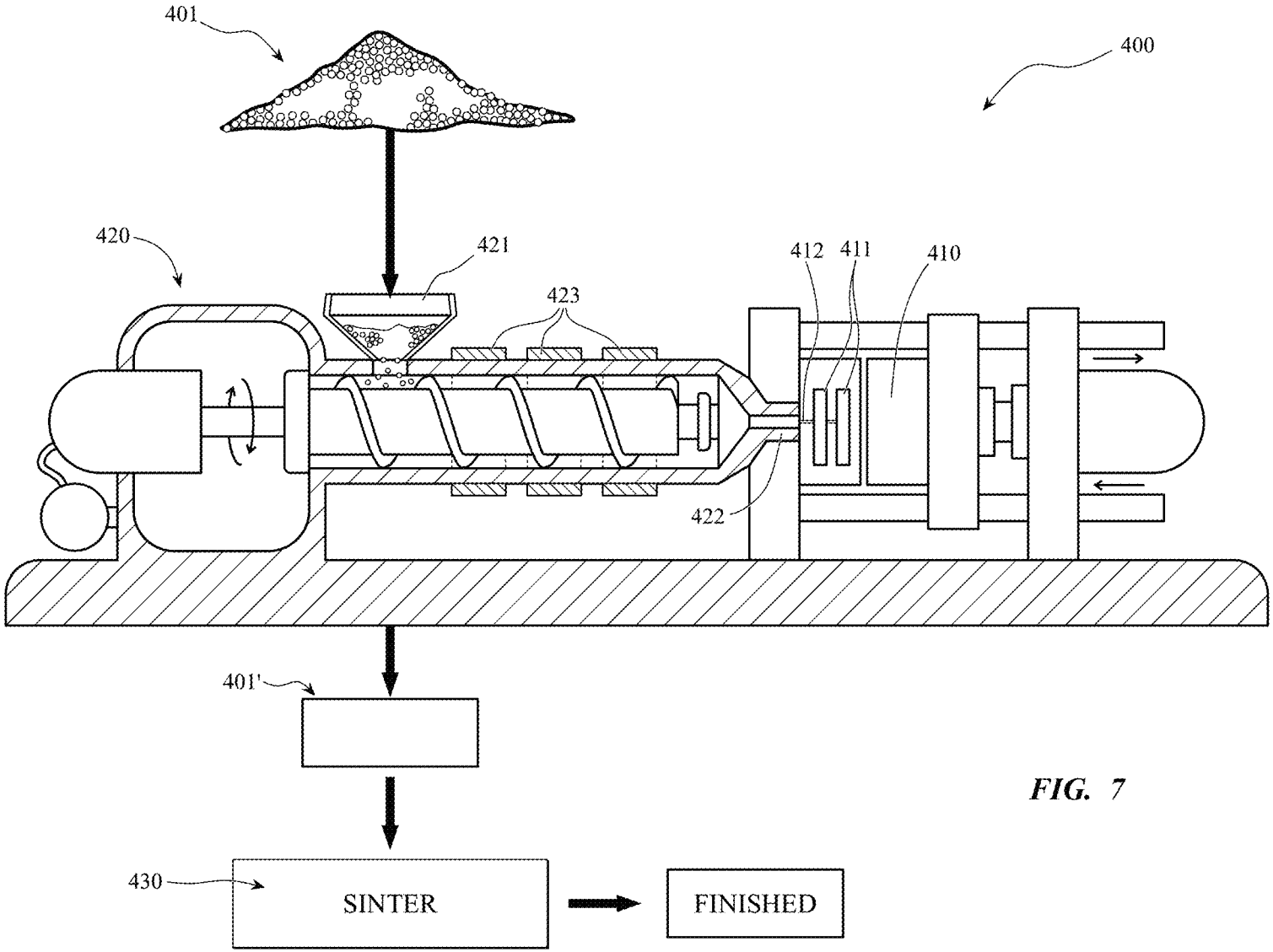
FIG. 7 shows a schematic view of a system for forming an article including an iron cobalt alloy.

FIG. 7 shows a schematic view of a system 400 for forming an article including an iron cobalt alloy. In some cases, the system 400 can be used to carry out the processes for forming an article, component, or alloy including about 34 wt % to about 38 wt % cobalt and about 62 wt % to about 68 wt % iron, for example, as described with respect to FIGS. 5 and 6. The system 400 can include a mold 410 including a cavity 411 for receiving a feedstock 401 including an iron cobalt alloy, as described herein. An injection apparatus 420 is configured to inject the feedstock 401 into the mold 410, and a furnace 430 can be used to, for example, sinter, heat treat, and/or remove binder, if any is present, from the molded material.

The mold 410 can include a cavity 411 having any desired shape or design. In some cases, the cavity 411 of the mold 410 can include a shape corresponding substantially to an inverse shape of an article including the iron cobalt alloy. In some cases, the cavity 411 can include multiple portions or regions in fluid communication with one another, each portion corresponding substantially to an inverse shape of an article so that multiple articles can be molded at the same time. The mold 410 can include an inlet 412 for receiving feedstock 401 into the cavity 411.

The feedstock 401 that can be provided into the mold 410 can include an iron cobalt alloy having about 32 wt % to about 38 wt % cobalt and about 62 wt % to about 68 wt % iron, as discussed herein. In some cases, the feedstock can include the iron cobalt alloy in powder form and can additionally include a binder, such as an organic or polymeric binder. Thus, in some cases, the feedstock 401 can be a slurry including a binder and an iron cobalt alloy powder having a composition of between about 32 wt % and about 38 wt % cobalt and about 62 wt % to about 68 wt % iron.

The feedstock 401 can be provided into the cavity 411 of the mold 410 via the inlet 412 by an injection apparatus 420. In some cases, the injection apparatus 420 and the mold 410 can be included as a single device or apparatus. In some cases, the injection apparatus 420 can be a plastic injection molding apparatus. In some cases, however, the injection apparatus 420 can be specifically designed or intended to be used in a metal injection molding process, for example, as discussed with respect to FIG. 6.

The injection apparatus 420 can include a hopper 421 for receiving the feedstock 401 to be injected into the mold 410. The hopper 421 can include any shape or form, and in some cases, can include a cavity or space for storing the feedstock 401. In some cases, the hopper 421 can be an inlet of the injection apparatus 420 and can receive feedstock 401 in any manner, for example, as fed to the hopper 421 by a hose or other device. The feedstock 401 can be moved from the hopper 421, through the body of the apparatus 420, to a nozzle 422, where it can be provided into the mold 410, as discussed herein. The nozzle 422 can be sized to correspond to the inlet 412 of the mold 410 and can positioned in fluid communication with and substantially adjacent thereto. The feedstock 401 can be moved from the hopper 421 to the nozzle 422 by, for example, a reciprocating screw, pump, plunger, or the like, of the injection apparatus 420.

In some embodiments, the feedstock 401 can be provided to the injection apparatus 420 in a substantially solid form and can be heated by the apparatus 420 to a substantially liquid state prior to being injected into the mold 410. In some cases, the feedstock 401 can be heated to a temperature such that the material 401 has rheological properties or characteristics that can allow or enable the feedstock 401 to conform to the shape of the cavity 411. Thus, in some embodiments, the injection apparatus 420 can include a heater 423 to achieve the above-described heating of the feedstock 401. The heater 423 can heat the feedstock 401 as it passes from the hopper 421 to the nozzle 422, and can, for example, be positioned adjacent to the screw, pump, plunger, or other system, that is used to move the feedstock 401 through the injection apparatus 420. In some other cases, however, the feedstock 401 can be provided in a heated and/or liquid state to the injection apparatus 420, and a heater may maintain a temperature of the feedstock 401, or may not be included in the injection apparatus 420 at all.

The system 400 can further include a furnace 430. The furnace 430 can receive the molded material 401' and can heat the molded material 401' to carry out a sintering, densification, binder removal, and/or heat treatment process for example as discussed with respect to FIGS. 5 and 6. Heating the molded material or body 401' in the furnace 430 can thus produce a formed article including the iron cobalt alloy described herein. In some embodiments, the molded material 401' can be removed from the mold 410 to produce a green body, and this green body or bodies can be received by the furnace 430 for heating therein. In some other cases, however, the molded material 401' can remain in the mold 410 while it is provided to the furnace 430 for heating.

The material properties of iron cobalt alloys having between about 32 wt % and about 38 wt % cobalt and about 62 wt % to about 68 wt % iron, and formed by the processes described herein, can include material properties that are unique to such iron cobalt alloys. For example, in some cases, an article including an iron cobalt alloy having a composition of between about 32 wt % and about 38 wt % cobalt and about 62 wt % to about 68 wt % iron and formed according to the processes discussed herein, such as a metal injection molding process, can include an average pore or void size of from about 1 micron to about 5 microns, from about 2 microns to about 4 microns, from about 2 microns to about 3.5 microns, from about 2 to about 2.5 microns, or from about 3 to about 3.5 microns. In some embodiments, the iron cobalt alloy of such an article can have an average grain size of from about 50 microns to about 100 microns, from about 60 microns to about 90 microns, from about 70 microns to about 80 microns, or from about 74 microns to about 77 microns, In some cases, an iron cobalt alloy can have an average grain size of about 75 microns. In some cases, however, an iron cobalt alloy can have an average grain size of greater than about 200 microns, greater than about 250 microns, 300 microns, 350 microns or greater.

Further, the density of an article including an iron cobalt alloy having a composition of between about 32 wt % and about 38 wt % cobalt and about 62 wt % to about 68 wt % iron and formed according to the processes discussed herein, such as a metal injection molding process can exhibit a density between about 88% and about 99%, between about 90% and about 98%, between about 92% and about 97%, between about 93% and about 97%, between about 94% and about 97%, or between about 95% and about 97%. In some cases, such an article can include less than about 5 wt % impurities, less than about 3 wt % impurities, less than about 1 wt % impurities, or less than about 0.5 wt %, 0.25 wt %, 0.1 wt %, 0.01 wt %, or even fewer impurities. In some cases, impurity elements can include nitrogen, oxygen, carbon, phosphorus, hydrogen, sulphur, and combinations thereof. In some embodiments, such an article can be substantially free of additive elements such as vanadium, chromium, copper, tungsten, nickel, manganese, and silicon.

Figure 8:
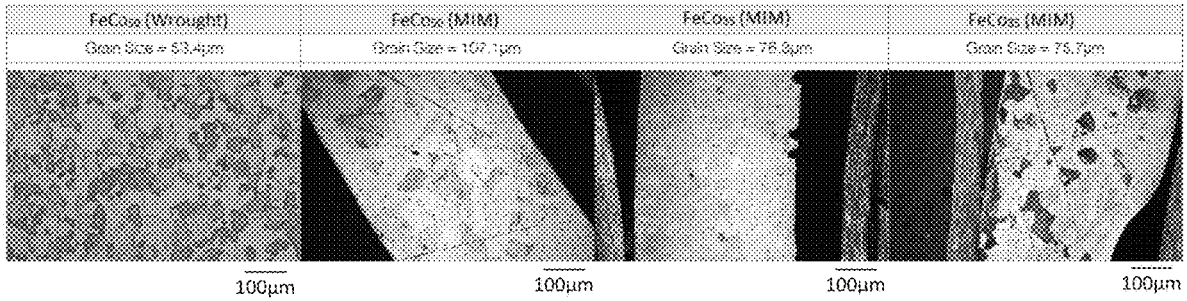
FIG. 8 shows a series of optical micrographs of iron cobalt alloy samples.

FIG. 8 shows a series of optical micrographs of iron cobalt alloys, including two samples of iron cobalt alloy having a composition of approximately 50 wt % iron and of approximately 50 wt % cobalt ($FeCo_{50}$), and two samples of iron cobalt alloy having a composition of approximately 35 wt % cobalt and approximately 65 wt % iron ($FeCo_{35}$). One of the $FeCo_{50}$) samples was formed or shaped by a wrought process, while the second $FeCo_{50}$ sample was formed by a metal injection molding process, for example, as described herein. Both of the $FeCo_{35}$ samples were formed by a metal injection molding process, as described herein.

As can be seen in FIG. 8, the $FeCo_{50}$ sample produced using the wrought process has an average grain size of about 54.4 microns, which is lower than the iron cobalt alloy samples prepared using a metal injection molding process, and significantly lower than the other $FeCo_{50}$ sample prepared using a metal injection molding process. Thus, in some cases, an iron cobalt alloy formed from a metal injection molding process can have an average grain size that is larger than the average grain size of an iron cobalt alloy having the same composition, produced by a wrought process. Further, it can be seen in FIG. 8 that the $FeCo_{35}$ samples have average grain sizes of about 76.3 microns and 75.7 microns, respectively. These average grain sizes are smaller than the 107.1 micron average grain size of the $FeCo_{50}$) sample produced by metal injection molding. Accordingly, in some cases, an iron cobalt alloy having between about 32 wt % and about 38 wt % cobalt and about 62 wt % to about 68 wt % iron, can have a smaller average grain size than an iron cobalt alloy prepared by a similar processing method, such as metal injection molding. Additionally, the iron cobalt alloy having between about 32 wt % and about 38 wt % cobalt and about 62 wt % to about 68 wt % iron, can have a grain size more akin to a wrought $FeCo_{50}$ alloy.

Figure 9:
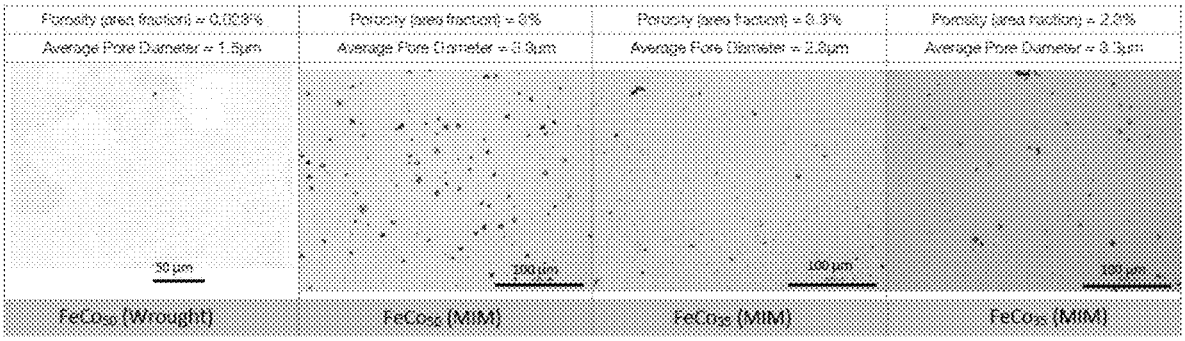
FIG. 9 shows a series of scanning electron micrographs of iron cobalt alloy samples.

FIG. 9 shows a series of scanning electron micrographs of the same iron cobalt alloy samples analyzed in FIG. 8, in the same respective order. That is, two $FeCo_{50}$ samples, one formed by a wrought process, the other formed by a metal injection molding process, and two $FeCo_{35}$ samples, each formed by metal injection molding processes. A survey of the pores or voids of each sample was taken from representative areas of the samples and the average pore size of the samples was calculated. The average pore or void diameter of the wrought $FeCo_{50}$ sample was found to be about 1.5 microns. The average pore diameter of the second $FeCo_{50}$ sample formed by a metal injection molding process was found to be approximately 3.3 microns. Accordingly, in some cases, an iron cobalt alloy formed by a metal injection molding process can have an average pore diameter or size that is much greater than an alloy of a similar composition that is formed by a wrought process.

As can be further seen in FIG. 9, the $FeCo_{35}$ samples were found to have an average pore diameter of 2.3 microns and 3.3 microns, respectively, while the metal injection molded $FeCo_{50}$ sample was found to have an average pore diameter of about 3.3 microns. The porosity of each sample was also measured. That is, the area fraction of each sample that was occupied by pores or voids in the representative micrograph. The $FeCo_{50}$ sample had a porosity of 3%. While this porosity was slightly lower than one of the $FeCo_{35}$ samples (found to be 3.3%), the average pore diameter of the $FeCo_{50}$ sample was 3.3 microns compared to 2.3 microns for the $FeCo_{35}$ sample. Similarly, while the average pore diameter of the $FeCo_{50}$ sample was about the same as the second $FeCo_{35}$ sample, the porosity of the second $FeCo_{35}$ sample was lower (found to be 2.3%) than the $FeCo_{50}$ sample. Thus, in some cases, an iron cobalt alloy having between about 32 wt % and about 38 wt % cobalt and about 62 wt % to about 68 wt % iron, can have a lower porosity (and higher density) than an iron cobalt alloy prepared by a similar processing method, such as metal injection molding, but having a higher weight percentage of cobalt, for example a $FeCo_{50}$ alloy.

Table 1, provided below, shows a variety of experimentally measured properties of iron cobalt alloy samples prepared by a metal injection molding process, for example, as described herein. As can be seen in the table, two $FeCo_{50}$ samples and two $FeCo_{35}$ samples were prepared. The samples were prepared using substantially similar processes and treatment regimes.

TABLE 1

| Sample Composition | % Density | $B_{sat}$ (T) | $B_r$ (T) | μMax | $H_c$ (A/m) |
|---|---|---|---|---|---|
| $FeCo_{50}$ | 94.8 | 2.286 | 1.683 | 9495.8 | 88.8 |
| $FeCo_{50}$ | 93.4 | 2.178 | 1.104 | 6823.6 | 75.6 |
| $FeCo_{35}$ | 95.7 | 2.176 | 0.508 | 1488.0 | 156.2 |
| $FeCo_{35}$ | 94.9 | 2.037 | 0.853 | 2000.6 | 155.7 |

The $B_{sat}$ is the saturation of the sample, as discussed herein, while the Br is the maximum magnetic flux density that the sample can produce. The $\mu_{Max}$ is the maximum permeability of the sample, as discussed herein. The $H_c$ of each sample is the coercive field strength, or the force necessary to demagnetize the sample. As can be seen in Table 1, the $FeCo_{35}$ samples were found to have higher densities than the $FeCo_{50}$ samples, which was consistent with the results as shown in FIG. 9 above. That is, in some cases, an iron cobalt alloy having between about 32 wt % and about 38 wt % cobalt and about 62 wt % to about 68 wt % iron, can have a lower porosity (and higher density) than an iron cobalt alloy prepared by a similar processing method, such as metal injection molding, but having a higher weight percentage of cobalt, for example a $FeCo_{50}$ alloy.

Further, despite the different compositions of the samples, the $B_{sat}$ of the $FeCo_{50}$ and $FeCo_{35}$ samples were found to be substantially similar. As discussed herein, in some applications, the $B_{sat}$ of an iron cobalt alloy can be the determinative material property for achieving a desired level of performance, irrespective of other material or magnetic properties, such as $\mu_{Max}$. Thus, while the FeCo35 samples may have different values for $B_r$, $\mu_{Max}$, and $H_c$, Table 1 illustrates that $FeCo_{50}$ and $FeCo_{35}$ samples can perform substantially similarly in some applications.

Any of the features or aspects of the iron cobalt alloys and processes for forming articles or components including the same can be combined or included in any variety of combinations. For example, an article or component including an iron cobalt alloy having between 32 wt % and 38 wt % cobalt and about 62 wt % to about 68 wt % iron, can include any design or shape and can be formed by any of the processes described herein, including a metal injection molding process. Further, an article including an iron cobalt alloy having between 32 wt % and 38 wt % cobalt and about 62 wt % to about 68 wt % iron and formed according to the processes described herein, can have any of the microstructural characteristics discussed herein in any combination, including an average pore size of between about 2 and about 4 microns, an average grain size of between about 60 and about 90 microns, and/or a density of between about 90% and about 98%.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent that many modifications and variations are possible in view of the above teachings.

What is claimed is:

1. A sintered magnetic component for an electronic device, comprising:

a metal alloy in a body-centered cubic phase and comprising about 32 weight percent (wt %) to about 38 wt % cobalt and about 62 wt % to about 68% wt % iron;

the sintered magnetic component having a porosity between 2% and 10% and an average pore size of 2 microns to 5 microns.

2. The component of claim 1, wherein the metal alloy has an average grain size of about 60 microns to about 100 microns.

3. The component of claim 1, wherein the metal alloy includes less than about 60 parts per million (ppm) of each of oxygen, phosphorus, and sulphur.

4. The component of claim 1, wherein the metal alloy is in an ordered body-centered cubic phase.

5. The component of claim 1, wherein the magnetic component is a magnetic shunt.

6. The component of claim 1, wherein the magnetic component is a magnetic retention component.

7. A magnetic article, comprising:

sintered particles comprising a magnetic alloy, the magnetic alloy comprising about 34 weight percent (wt %) to about 36 wt % cobalt and about 64 wt % to about 66 wt % iron;

the magnetic article in an ordered body-centered cubic phase and having an average pore size of 2 microns to 5 microns.

8. The magnetic article of claim 7, wherein the alloy includes about 35 wt % cobalt and about 65 wt % iron.

9. The magnetic article of claim 7, wherein the magnetic article has a porosity less than about 10%.

10. The magnetic article of claim 7, wherein the magnetic article has an average grain size of about 60 microns to about 100 microns.

11. The magnetic article of claim 7, wherein the alloy has a saturation magnetization ($B_{sat}$) of about 2 tesla (T) to about 2.3 T.

12. The magnetic article of claim 11, wherein the article is a magnetic shunt.

13. A method of forming a sintered article from a feedstock, comprising:

heating a binder and the feedstock, the feedstock having about 34 weight percent (wt %) to about 36 wt % cobalt and about 64 wt % to about 66 wt % iron;

injecting the heated binder and feedstock into a mold; and cooling the heated binder and feedstock; and sintering the feedstock to form the sintered article, the sintered article comprising about 34 weight percent (wt %) to about 36 wt % cobalt and about 64 wt % to about 66 wt % iron and in an ordered body-centered cubic phase and having an average pore size of 2 microns to 5 microns.

14. The method of claim 13, wherein:

the feedstock comprises a powder; and

90% of the particles of the powder have a maximum diameter of less than about 16 microns.

15. The method of claim 13, further comprising:

sintering the article at a temperature between about 600° C. to about 800° C.; and cooling the sintered article at a rate so that the article is in an ordered body-centered cubic phase.

* * * * *